United States Patent [19]

Schultze et al.

[11] Patent Number: 4,657,794

[45] **Date of Patent: * Apr. 14, 1987**

[54] BINDERLESS CERAMIC OR CERAMIC OXIDE HOLLOW BODY AND METHOD FOR ITS MANUFACTURE

[75] Inventors: Werner Schultze, Bonn; Knut Weber, Jr., Wiehl, both of Fed. Rep. of Germany

[73] Assignee: Vereinigte Aluminium-Werke Aktiengeselschaft, Fed. Rep. of Germany

[ * ] Notice: The portion of the term of this patent subsequent to Jul. 17, 2001 has been disclaimed.

[21] Appl. No.: 768,612

[22] Filed: Aug. 23, 1985

Related U.S. Application Data

[60] Continuation of Ser. No. 510,876, Sep. 27, 1983, Pat. No. 4,547,415, which is a division of Ser. No. 225,191, Jan. 15, 1981, Pat. No. 4,460,529.

[51] Int. Cl.[4] ..... B07D 7/22; B07D 1/36; B05D 3/02

[52] U.S. Cl. ..... 428/36; 428/697; 428/698; 428/702

[58] Field of Search ..... 428/36, 690, 697, 698, 428/702

[56] References Cited

U.S. PATENT DOCUMENTS

| | | | |
|---|---|---|---|
| 4,005,235 | 1/1977 | Prochazka | 428/36 |
| 4,082,863 | 4/1978 | Dancy et al. | 428/36 |
| 4,117,868 | 10/1978 | Pignocco et al. | 428/36 |
| 4,330,496 | 5/1982 | Desplanches et al. | 428/36 |

*Primary Examiner*—John E. Kittle
*Attorney, Agent, or Firm*—Darby & Darby

[57] ABSTRACT

This invention relates to a ceramic or ceramic oxide hollow body and a method for its manufacture. The ceramic or ceramic oxide hollow body of the present invention does not require the use of a binder or adhering substrate or any type of internal embedded supports. The hollow body is capable of being manufactured for any desired diameter and length and is especially suited for thick walled pipes. The ceramic hollow body is homogeneous, free of internal cracks, and highly heat stable and shock insensitive. It is produced in a continuous quasi-isothermal thermal spray process in which hot atomized ceramic or ceramic oxide particles are sprayed as a plasma onto a non-adhering highly thermally conductive internally cooled mold core. The mold core is mounted on a rotating lathe which in turn is mounted on a longitudinally movable carriage to accomplish the uniform layer thickness of the hollow body. The mold core is removable from the hollow body and the hollow body thus removed is capable of being directly used without sintering.

5 Claims, 2 Drawing Figures

BINDERLESS CERAMIC OR CERAMIC OXIDE HOLLOW BODY AND METHOD FOR ITS MANUFACTURE

This is a continuation of application Ser. No. 510,876, filed 9/27/83, now U.S. Pat. No. 4,547,415 which was a divisional of Ser. No. 225,191, filed Jan. 15, 1981, now U.S. Pat. No. 4,460,529.

BACKGROUND OF THE INVENTION

This invention relates to a binderless ceramic or ceramic oxide hollow body and a method for its manufacture.

Ceramic or ceramic oxide hollow bodies are used for calcining pipes, as containers for highly toxic and radioactive materials and wastes and as fire resistant linings, pipe insulation and high temperature process pipes in many industries. The microporous structure of the ceramic hollow body provides high temperature stability.

Ceramic materials may be formed into hollow bodies by a variety of conventional processes such as dry pressing, wet extrusion, slip molding, isostatic pressing, hot pressing, and injection pressing. In the dry pressing processes a ground ceramic powder is dry-mixed with an organic binder, such as dextrin, and subjected to high pressures on the order of 1000 atmospheres inside steel molds. In wet extrusion processes the ceramic powder and binder are slurry-mixed and extruded through nozzles in a plastic consistnency.

Conventional processes require the hollow body to undergo high temperature sintering to achieve mechanically strong products. The sintering step is generally conducted in gas-fired tunnel furnaces or kilns at temperatures on the order of 1650° C. to 1850° C. This sintering process prevents cost effective manufacture of large diameter and/or long hollow bodies due to the prohibitive cost of the associated furnaces or kilns.

Another process for producing ceramic oxide hollow bodies is known as flame spraying as described in W. German Pat. No. 1,646,667. The ceramic oxide powder is atomized at high temperature resulting in a partial or complete change in its state of aggregation. The atomized particles are sprayed onto a rough surface of a solid substrate. This substrate acts as a binder. The particles bind to each other and with the substrate. This process presents disadvantages when thick-walled hollow bodies are required, because, as the ceramic oxide layers build up there is no longer any available surface area on the substrate to aid in bonding. As a result the outer layers tend to detach from the inner bound layers. In addition, due to the non-uniform temperature gradient between the substrate-ceramic layer and the purely ceramic layers internal cracks develop in the body. This leads to lower mechanical strength for the hollow body and increased permeability. The increase in permeability may result in leakage due to diffusion of gases or liquids from the interior through the hollow body. This process has not, therefore, been found to be effective when thick walled impermeable ceramic or ceramic oxide hollow bodies such as thick walled pipes are required.

SUMMARY OF THE INVENTION

It is therefore an object of the present invention to produce a purely ceramic or ceramic oxide hollow body which does not have any of the physical disadvantages of the prior art. The ceramic hollow body of the present invention does not require the use of any binder or binding substrate. The hollow body is homogeneous, microporous, highly heat stable and shock insensitive.

A second object of the invention is to produce a mechanically strong hollow body without the need for preformed or post-production sintering.

Another object of the invention is to produce a thick walled ceramic or ceramic oxide hollow body pipe having a wall thickness greater than 5 millimeters which presents no outer layer detachment and free of internal cracks.

A further object of the invention is a quasi-isothermal thermal spray process for ceramic or ceramic hollow bodies utilizing an internally cooled non-binding removable mold core selected for its high thermal conductivity in relation to the ceramic or ceramic oxide material to be used.

The term quasi-isothermal as used herein refers to a process in which the temperature gradient from the flame spraying zone to the cooling zone of the mold core does not exceed 2° C. per millimeter of the ceramic or ceramic oxide layer. The quasi-isothermal process results in uniform purely ceramic or ceramic oxide hollow bodies of high mechanical strength without internal cracks.

DESCRIPTION OF THE DRAWINGS

The objects of the process for manufacturing binderless ceramic or ceramic oxide hollow bodies of any desired dimension will become more apparent in reference to the accompanying FIGS. 1 and 2.

Figure 1:
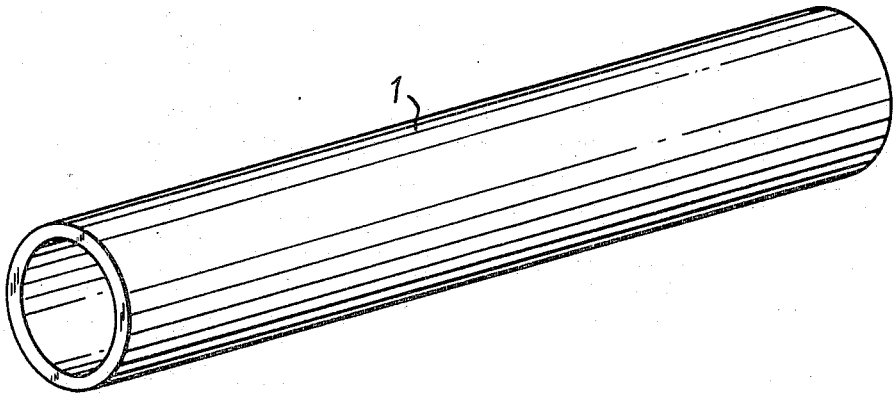
FIG. 1 is a perspective view, reduced in size, of a pipe of ceramic or ceramic oxide produced by the present invention.

The pipe 1, shown in FIG. 1, consists only of ceramic or ceramic oxide material. In particular, it contains no binders or mechanical supports in the form of internal or embedded pipes or cross connections nor does it require any binding substrate. Any ceramic or ceramic oxide material which can be applied by thermal spraying may be chosen. The chemical composition of a typical ceramic body composition preferred for use in the present invention comprises aluminum and titanium carbides, borides and nitrides and mixtures thereof having a purity of at least 99%. The ceramic oxides which may be employed are e.g. magnesium, aluminum and titanium oxides and mixtures thereof having purities in the range of at least 99.5%. The choice depends on the intended purpose of the hollow body. The pipe is porous and its length, diameter and wall thickness can be freely selected.

Figure 2:
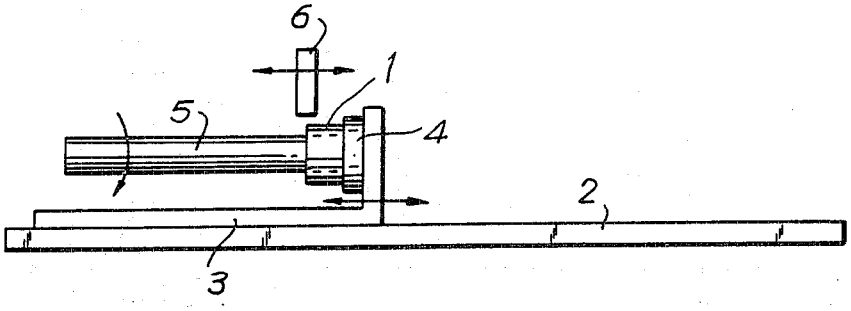
FIG. 2 is a top view of the equipment used to manufacture the pipe shown in FIG. 1.

The pipe 1 is made by a thermal spraying process on the equipment shown in FIG. 2. The equipment is constructed in the nature of a lathe. A carriage 3 is slidably moveable along the bed 2 of the lathe in the longitudinal direction. At the front wall 10, the carriage 3 carries a rotatable chuck 4, which holds a hollow mold core 5. The hollow mold core 5 is selected so that it length is greater than or equal to the length of the desired hollow body and its outer diameter is the same as the desired inner diameter of the resulting hollow body. The mold core 5 is cooled internally by a flowing fluid (e.g. water) flowing through duct 12. The core material is selected so that its thermal conductivity is such that in relation to the ceramic or ceramic oxide material of the hollow body rapid uniform heat transfer is accomplished to maintain the quasi-isothermal nature of the process. The thermal spraying equipment 6 is positioned in close proximity to the mold core 5 at a selected distance to enable its spray nozzle 8 to distribute an even layer of ceramic or ceramic oxide through the plasma jet onto on the exterior mold core surface. The spraying equipment 6 is also positioned to enable it to be moved in the radial 15 and axial 15 direction relative to the mold core. This construction allows the spraying operation to proceed by rotation of the mold core alone, and axial movement of the thermal spraying equipment. Alternatively the mold core may be rotated and moved axially 13 by the carriage 3 while maintaining the thermal spraying equipment stationery.

The ceramic or ceramic oxide powder is fed into the thermal spraying equipment and heated such that atomized nonaggregated ceramic or ceramic oxide particles in the form of a plasma are sprayed onto the mold core. The particles are uniformly and continuously sprayed onto the mold core to form a layer of constant thickness, selected to be between 0.05 to 0.15 mm, on the mold core while maintaining a quasi-isothermal temperature gradient. Upon being subjected to the much colder surface of the mold core, the plasma particles become fused together, but do not fuse to the mold core. The heat of the particles is rapidly conducted away from the ceramic or ceramic oxide layer through the mold core and carried away by the flowing cooling fluid.

An exterior cooling device 7 is located parallel to the axis 12 of the mold core and ceramic or ceramic oxide hollow body. This device contains a series of axially extending nozzles a for application of a stream of compressed gas onto the exterior of the ceramic or ceramic oxide layer. The exterior cooling device 7 serves two important functions. It is used after the ceramic layer has fused to remove loose nonbound ceramic or ceramic oxide dust particles which have reflected off of the surface of the mold core, and have cookled by the ambient air and redeposited as a non-adhering layer on the ceramic fused layer. The ceramic dust particles must be removed prior to depositing each additional layer of ceramic or ceramic oxide when a thicker wall body is required. If the dust is not removed prior to the addition of the next layer the homogeneity, microporous structure and mechanical and thermal stability of the hollow body would be reduced. This exterior cleaning is repeated after each successive layer of ceramic is laid down. As the thickness of the ceramic layers builds up, in order to maintain the quasi-isothermal temperature gradient the temperature of the internal cooling fluid is accordingly lowered taking into account the reduced thermal conductivity of the ceramic layered core. In addition to reducing the internal cooling fluid temperature, the exterior cooling device may be used to circulate cool compressed gas onto the outer surface of the successive layer of hollow body. As a result of the combined action of the internal cooling fluid and the exterior compressed gas, quasi-isothermal operation can be maintained when wall thicknesses greater than 5 mm are desired.

The internal cooling fluid may be a liquid compatible with the mold core material and having a suitable temperature differential between its operating temperature and its bubble point or critical temperature such that its temperature can be raised when subjected to the heat transferred from the mold core without expanding rapidly and distorting the shape of the mold core. The internal cooling fluid is preferably water. The direction of the cooling fluid is preferably countercurrent with the axial direction of the thermal spraying. Other coolants such as low melting salt mixtures, and thermo oils such as Therminol$_R$ type 60 having a range of use from −60 to +600 degrees F. or Therminol$_R$ type 80 having a range of use from 300 to 750 degrees. These therminol oils are sold under the above trademarks registered to the Monsanto Corporation.

The external compressed gas must be directed with a velocity sufficient for cleaning and cooling. It must be directed arcuately to the surface of the hollow body in such a way as to be distributed uniformly over the entire exterior surface. It is preferred that the compressed gas be at a pressure in excess of 1 atmosphere. Nitrogen carbon dioxide are examples of three preferred gasses for use in the invention.

The mold core may be constructed of metallic or non-metallic materials having good thermal conductivity and which are non-adhering to ceramic or ceramic oxides. Metallic mold core materials found suitable for this process include all pure metals and alloys with a high coefficient of expansion, such as copper, aluminum, alloys of aluminum and beryllium (Al 95.8%, Be 4.2%), aluminum and magnesium (Al 85.9%, Mg 12.7% remainder Si, Fe and Co) or magnesium and aluminum (Mg 90–96%, Al 10–14%). The preferred metallic mold core material is aluminum. Non-metallic mold cores found to be satisfactory are cardboard, wood or plastic having a non-adhering heat resistant layer of glass fiber-coated polytetra-fluoroethylene (Teflon) or heat resistant textiles in the form of tapes or sheets, and contact with the ceramic. In such cases the cardboard must be protected from the high temperatures by very strong internal cooling. These mold cores can be separated from the hollow body by shrinkage or by destruction such as, for example, by combustion of the cardboard. Whatever mold core material is selected it must not bind with or cling to the ceramic material.

The detachability of the mold core from the hollow body can be assured by the choice of a core with a higher coefficient of expansion relative to that of the ceramic or ceramic oxide layer or by the construction of the core as an expanding mandrel. It is preferred to select a mold core which can be re-used to manufacture additional pipes.

After the desired wall thickness of the ceramic or ceramic oxide hollow body is achieved it is removed from the core. This can be accomplished for example by shrinking the core or constructing the core as an expanding mandrel. The next ceramic pipe body can then be sprayed on the mold core. Upon removal the hollow body can be immediately transported and used without a final sintering operation. Sintering may become desirable when hollow bodies with wall thickness in excess of 20 mm are required.

What is claimed is:

1. A hollow body comprising layers of fused particles, said particles being selected from the group consisting of ceramic and ceramic oxide particles, said particles being free of any binding agent, said body being porous, free of internal adhering supports, and having been produced by exposing said layers to a temperature gradient which does not exceed 2° C. per millimeter of layer thickness.

2. A hollow body according to claim 1 wherein said body has an exterior wall thickness greater than about 5 mm.

3. A hollow body as defined in claim 1, said body being impermeable, highly heat stable, shock resistant and free of internal cracks.

4. The hollow tubular body according to claidm 1 which comprises a ceramic material containing at least one member selected from the group consisting of the carbides, borides and nitrides of aluminum and titanium, said ceramic material being at least 99 weight percent pure.

5. The hollow tubular body according to claim 1 which comprises at least one ceramic material selected from the group consisting of aluminum oxide, magnesium oxide, titanium oxide and mixtures thereof, said ceramic oxide material being at least 99.5 weight percent pure.

* * * * *